US006186772B1

(12) United States Patent
Huang

(10) Patent No.: US 6,186,772 B1
(45) Date of Patent: Feb. 13, 2001

(54) LIGHTER HAVING A SAFETY MECHANISM

(76) Inventor: Ying Fang Huang, No. 2, Lane 22, Sec. 2, San Hsi Road, Taichung, 404 (TW)

( * ) Notice: Under 35 U.S.C. 154(b), the term of this patent shall be extended for 0 days.

(21) Appl. No.: 09/556,370

(22) Filed: Apr. 24, 2000

(51) Int. Cl.[7] ..... F23Q 2/28

(52) U.S. Cl. ..... 431/132; 431/153

(58) Field of Search ..... 431/153, 132, 431/255

(56) References Cited

U.S. PATENT DOCUMENTS 5,531,591 * 7/1996 Yamazaki ..... 431/153

* cited by examiner

*Primary Examiner*—Ira S. Lazarus
*Assistant Examiner*—Sara Clarke
(74) *Attorney, Agent, or Firm*—Charles E. Baxley

(57) ABSTRACT

A lighter includes a housing for receiving gas fuel and having an ignitor device and having an orifice. A cap is pivotally secured to the housing and has an aperture aligning with the orifice of the housing. A latch is slidably engaged in the cap and biased to engage into the orifice of the housing. A knob is slidably received in the cap and movable toward the latch and includes one or more legs engaged with the latch for disengaging the latch from the housing and for allowing the cap to be rotated and opened when the latch is disengaged from the housing.

10 Claims, 7 Drawing Sheets

LIGHTER HAVING A SAFETY MECHANISM

BACKGROUND OF THE INVENTION

1. Field of the Invention

The present invention relates to a lighter, and more particularly to a lighter having a safety mechanism.

2. Description of the Prior Art

Typical lighters comprise a cap pivotally secured to a housing at a pivot shaft for actuating an ignitor device and a valve device when the cap is rotated about the pivot shaft. No safety device is provided for locking the cap and for preventing the ignitor device from being actuated by the cap inadvertently.

The present invention has arisen to mitigate and/or obviate the afore-described disadvantages of the conventional lighters.

SUMMARY OF THE INVENTION

The primary objective of the present invention is to provide a lighter having a safety mechanism for preventing the cap from being actuated inadvertently by the children.

In accordance with one aspect of the invention, there is provided a lighter comprising a housing including a chamber formed therein for receiving gas fuel therein, and including an ignitor device received therein, the housing including an orifice formed therein for allowing the gas fuel to flow outward of the housing, a cap pivotally secured to the housing at a pivot shaft, the cap including an aperture for aligning with the orifice of the housing, a latch slidably engaged in the aperture of the cap and the orifice of the housing in order to lock the cap to the housing, and means for disengaging the latch from the orifice of the housing in order to release the cap from the housing. The cap is allowed to be rotated about the pivot shaft when the latch is disengaged from the orifice of the housing.

A spring biasing device is further provided for biasing the latch to engage into the orifice of the housing. A guiding device is further provided for guiding the latch to move relative to the cap and includes a block extended in the cap, the latch has a projection slidably engaged with the block of the cap for guiding the latch to move relative to the cap and for preventing the latch from rotating relative to the cap.

The latch includes at least one arm laterally extended outward therefrom, the disengaging means includes a knob slidably received in the cap and having at least one leg extended therefrom for engaging with the arm and for disengaging the latch from the orifice of the housing. The leg includes a tapered end, the arm includes a tapered end for engaging with tapered end of the leg. The cap includes a lid having an opening formed therein for slidably receiving the knob, and for allowing the knob to be moved toward the latch.

A spring biasing device is further provided for biasing the knob away from the latch and includes a spring blade extended from the knob and engaged with the cap for biasing the knob away from the latch. The cap includes a cavity formed therein, the spring blade includes a bulge extended therefrom for engaging with the cavity of the cap and for positioning the spring blade to the cap.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 3:
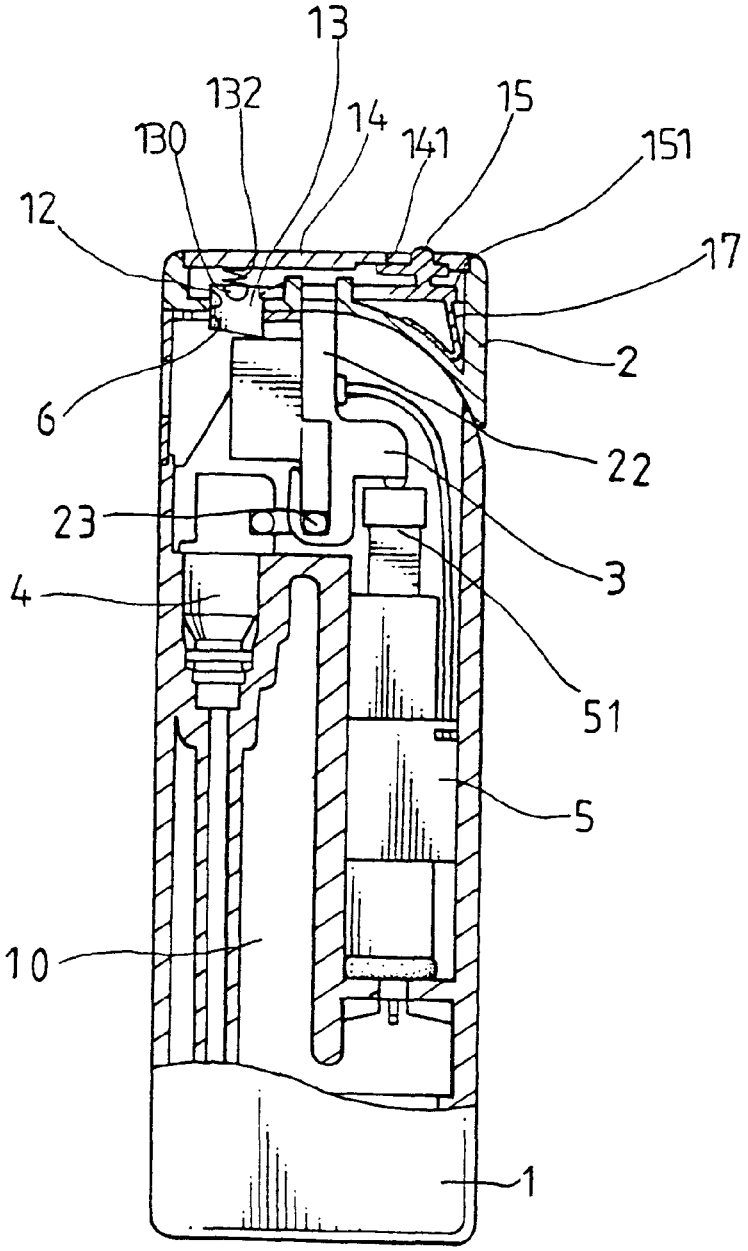
FIG. 3 is a partial cross sectional view taken along lines 3—3 of FIG. 1.
Figure 4:
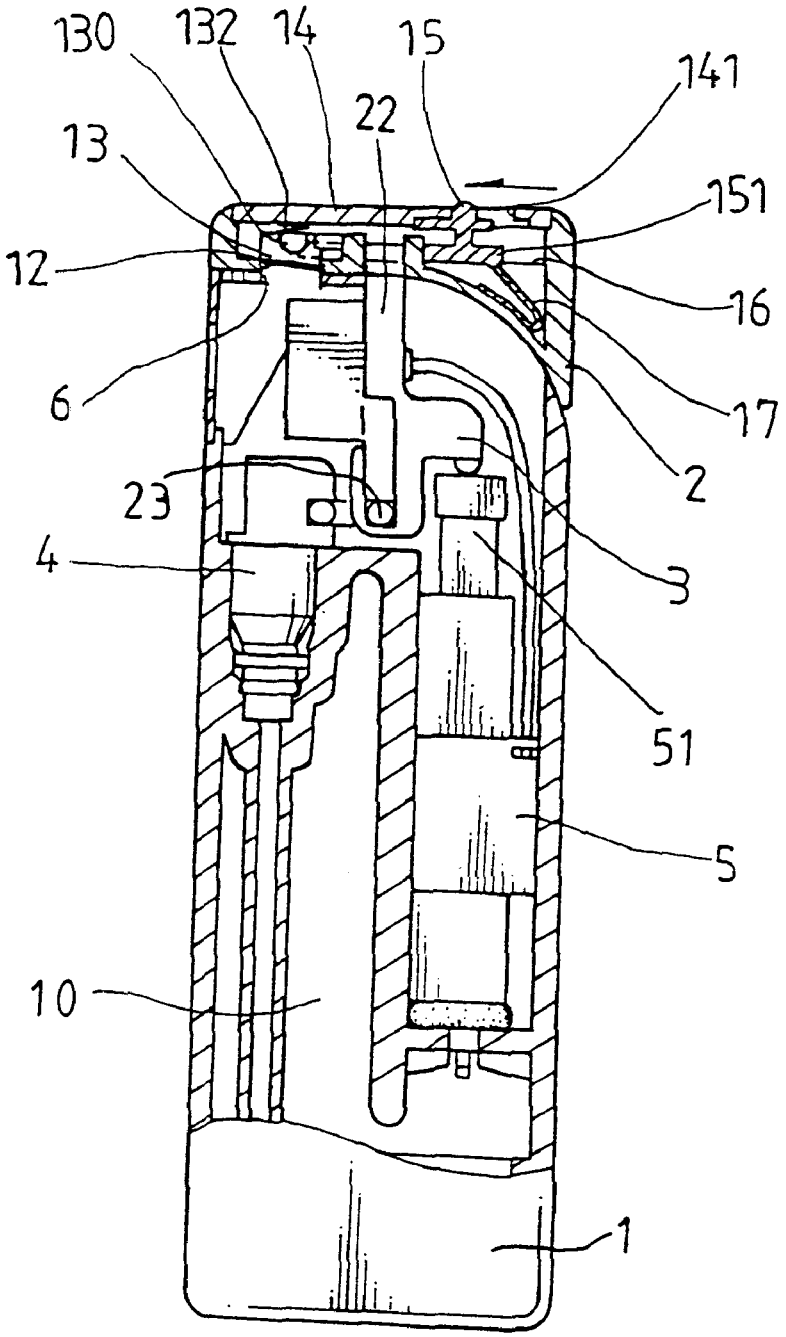
FIGS. 4 and 5 are partial cross sectional views similar to FIG. 3, illustrating the operation of the lighter.
Figure 5:
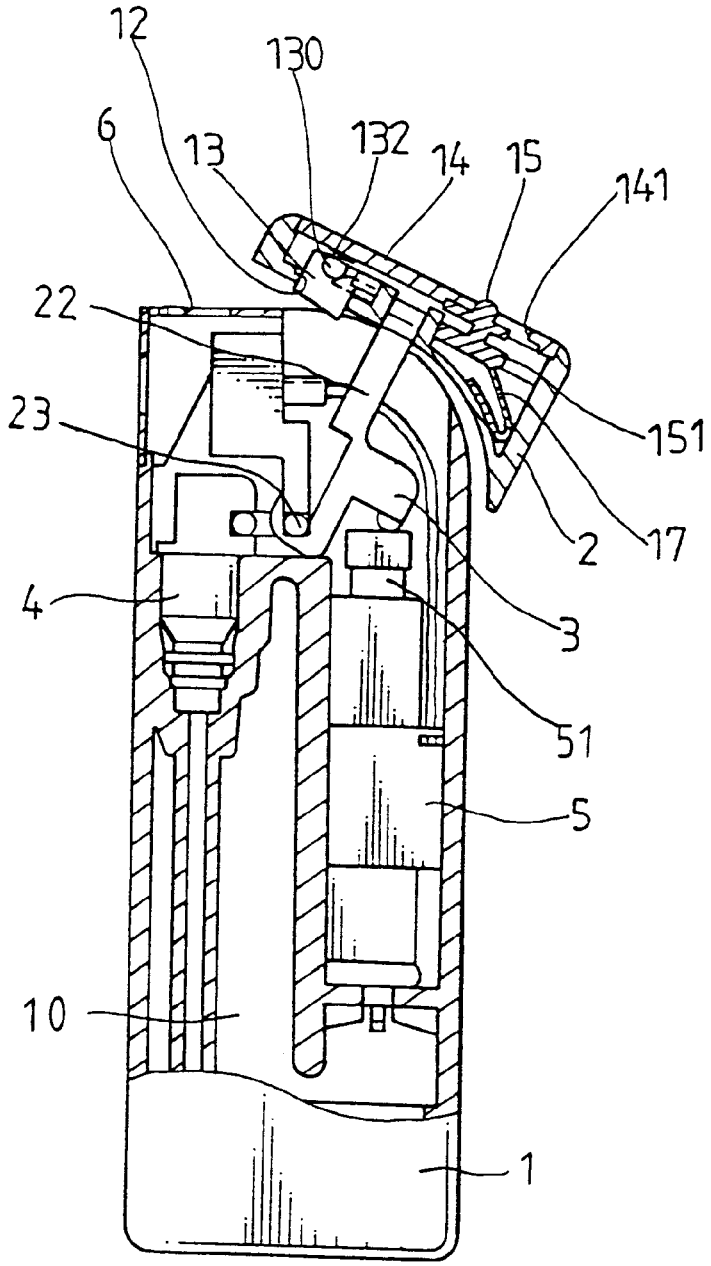

Referring to the drawings, and initially to FIGS. 1–4, a lighter in accordance with the present invention comprises a housing 1 including a chamber 10 formed therein for receiving the gas fuel or the like. A valve 4 is typically disposed in the housing 1 for controlling the outward flowing of the gas fuel. An ignitor device 5 is disposed in the housing 1 for igniting the gas fuel and includes a switch 51. A cap 2 includes an extension 22 extended inward of the housing 1 and pivotally secured to the housing 1 at a pivot shaft 23 for allowing the cap 2 to be rotated about the pivot shaft 23 for a limited angular movement. The cap 2 includes an actuator 3 extended therefrom for engaging with the switch 51 of the ignitor device 5 and for igniting the gas fuel when the cap 2 is rotated about the pivot shaft 23 (FIG. 5). The valve 4 may also be actuated by the cap 2 when the cap 2 is rotated to actuate the ignitor device 5. The cap 2 also forms as the upper cover for the housing 1. The housing 1 includes an orifice 6 formed in the upper portion thereof (FIGS. 2, 5) for allowing the gas fuel to flow outward of the housing 1. The above structure is typical and will not be described in further details.

Figure 1:
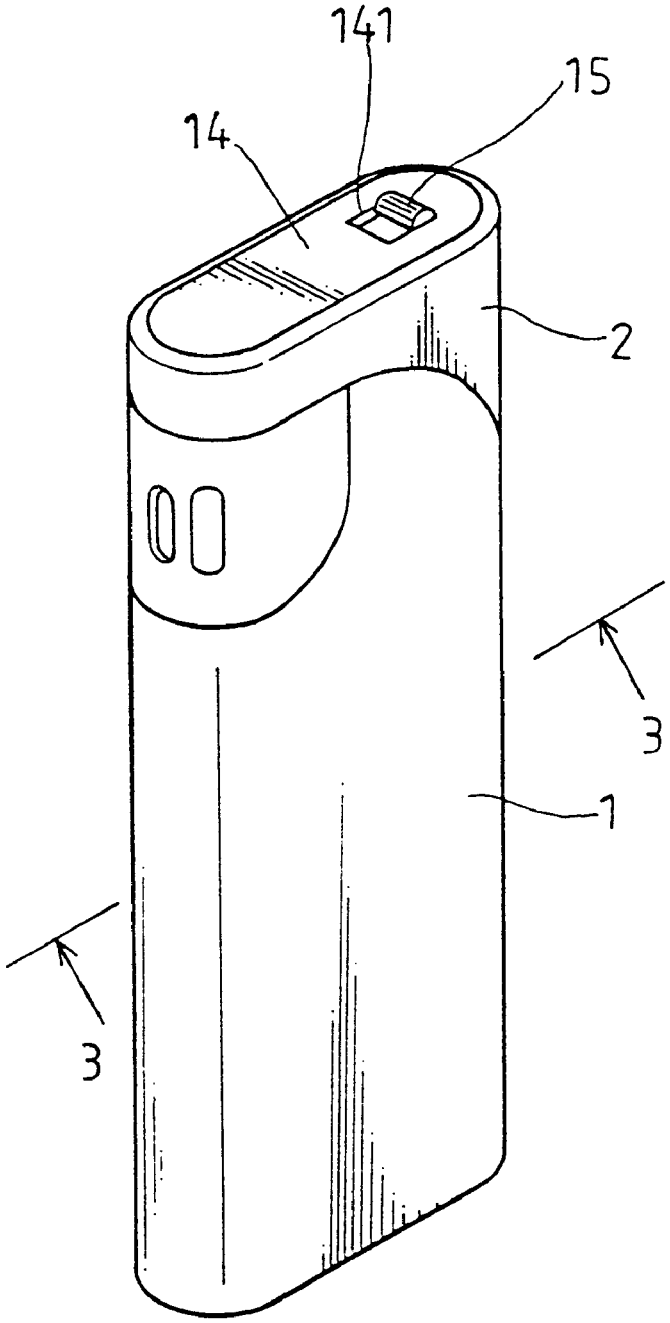
FIG. 1 is a perspective view of a lighter in accordance with the present invention.
Figure 2:
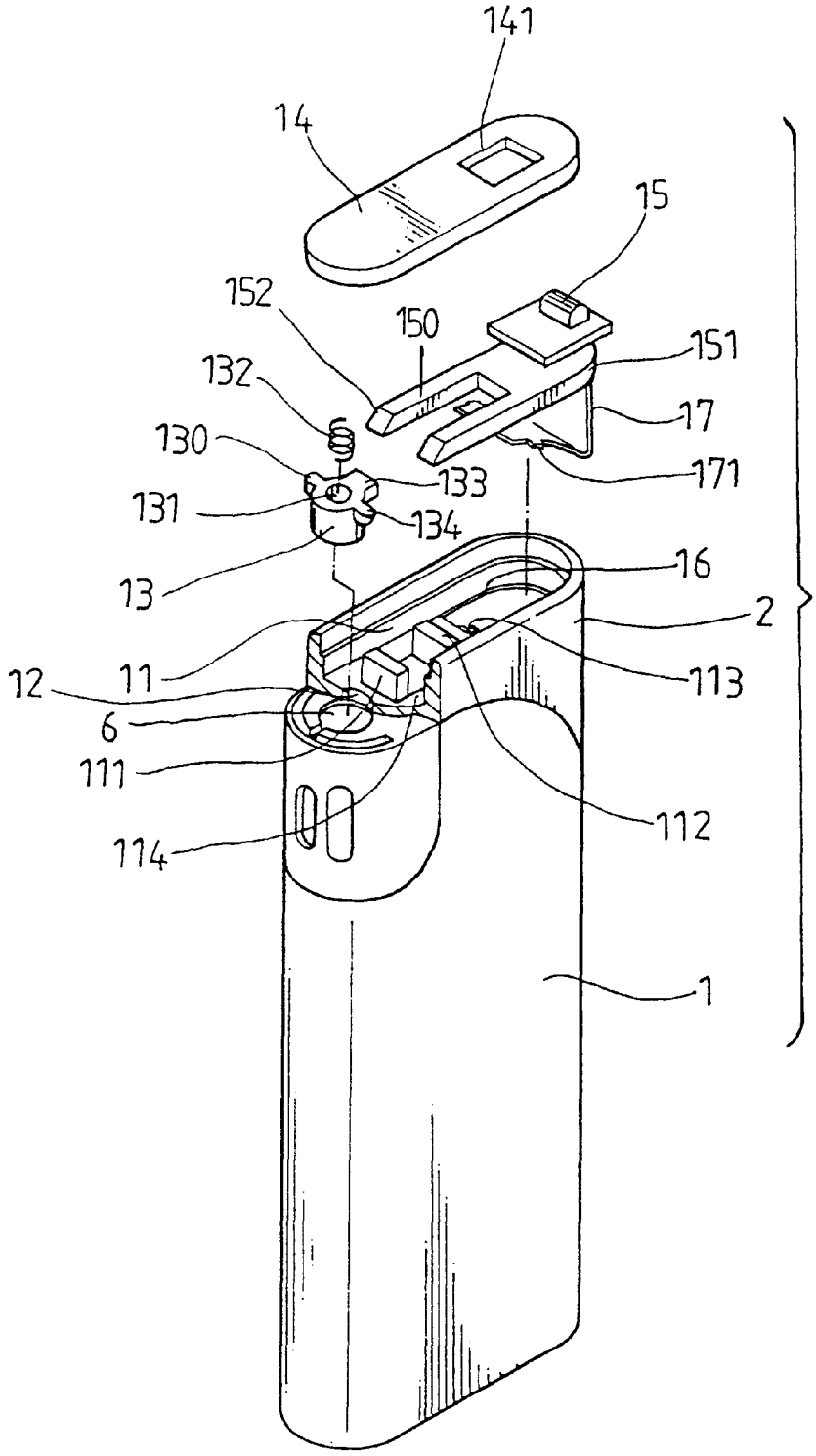
FIG. 2 is a partial exploded view of the lighter.

The cap 2 includes a space 11 formed therein and includes a pair of blocks 111, 112 extended upward into the space 11 from the bottom of the cap 2 for defining a pair of channels 114 on both sides of the blocks 111, 112. The cap 2 includes a cavity 113 formed therein (FIG. 2). The cap 2 includes an aperture 12 formed therein and aligned with the orifice 6 of the housing 1, and includes a guide track 16 formed therein.

A latch 13 is slidably received in the aperture 12 of the cap 2 and the orifice 6 of the housing 1 for locking the cap 2 to the housing 1 and for preventing the cap 2 from being opened inadvertently. The latch 13 includes a pair of arms 130 extended laterally outward therefrom for engaging with the cap 2 and for preventing the latch 13 from being disengaged from the cap 2. The arms 130 each includes a tapered surface 134 formed in the bottom portion thereof (FIGS. 2, 6), and each includes a portion or a projection 133 extended therefrom for slidably engaging with the block 111 and for preventing the latch 13 from rotating relative to the cap 2. The latch 13 includes a hole 131 formed in the upper portion thereof for receiving a spring 132. A lid 14 is secured on top of the cap 2 and engaged with the spring 132 which may bias the latch 13 to engage into the aperture 12 of the cap 2 and the orifice 6 of the housing 1 for locking the cap 2 to the housing 1 and for preventing the cap 2 from being opened inadvertently. The lid 14 includes an opening 141 formed therein.

A knob 15 includes a pair of legs 150 extended from a base 151 thereof. The base 151 is slidably engaged on the guide track 16 of the cap 2. The legs 150 each includes a tapered surface 152 formed on the free end thereof and engaged with the tapered surfaces 134 of the arms 130 of the latch 13 for moving the latch 13 against the spring 132 and for disengaging the latch 13 from the orifice 6 of the housing 1 (FIG. 4) when the knob 15 is moved toward the latch 13. The knob 15 is partially exposed or is partially extended outward through the opening 141 of the lid 14 for allowing the knob 15 to be moved toward the latch 13 by the users. The knob 15 includes a spring blade 17 extended therefrom and received in the cap 2 and having a bulge 171 (FIG. 2) for engaging with the cavity 113 of the cap 2 and for securing the spring blade 17 to the cap 2. The spring blade 17 may bias and disengage the legs 150 of the knob 15 from the latch 13.

In operation, as shown in FIG. 3, the legs 150 of the knob 15 may be biased and disengaged from the latch 13, such that the latch 13 may be biased to engage into the aperture 12 of the cap 2 and the orifice 6 of the housing 1 for locking the cap 2 to the housing 1 and for preventing the cap 2 from being opened inadvertently. When it is required to actuate the lighter, the knob 15 is moved against the spring blade 17 for moving the legs 150 of the knob 15 toward the latch 13 and for disengaging the latch 13 from the orifice 6 of the housing 1 (FIG. 4). The cap 2 may thus be rotated about the pivot shaft 23 when the latch 13 is disengaged from the orifice 6 of the housing 1 (FIG. 5), such that the actuator 3 of the cap 2 may be caused to actuate the ignitor device 5.

Figure 6:
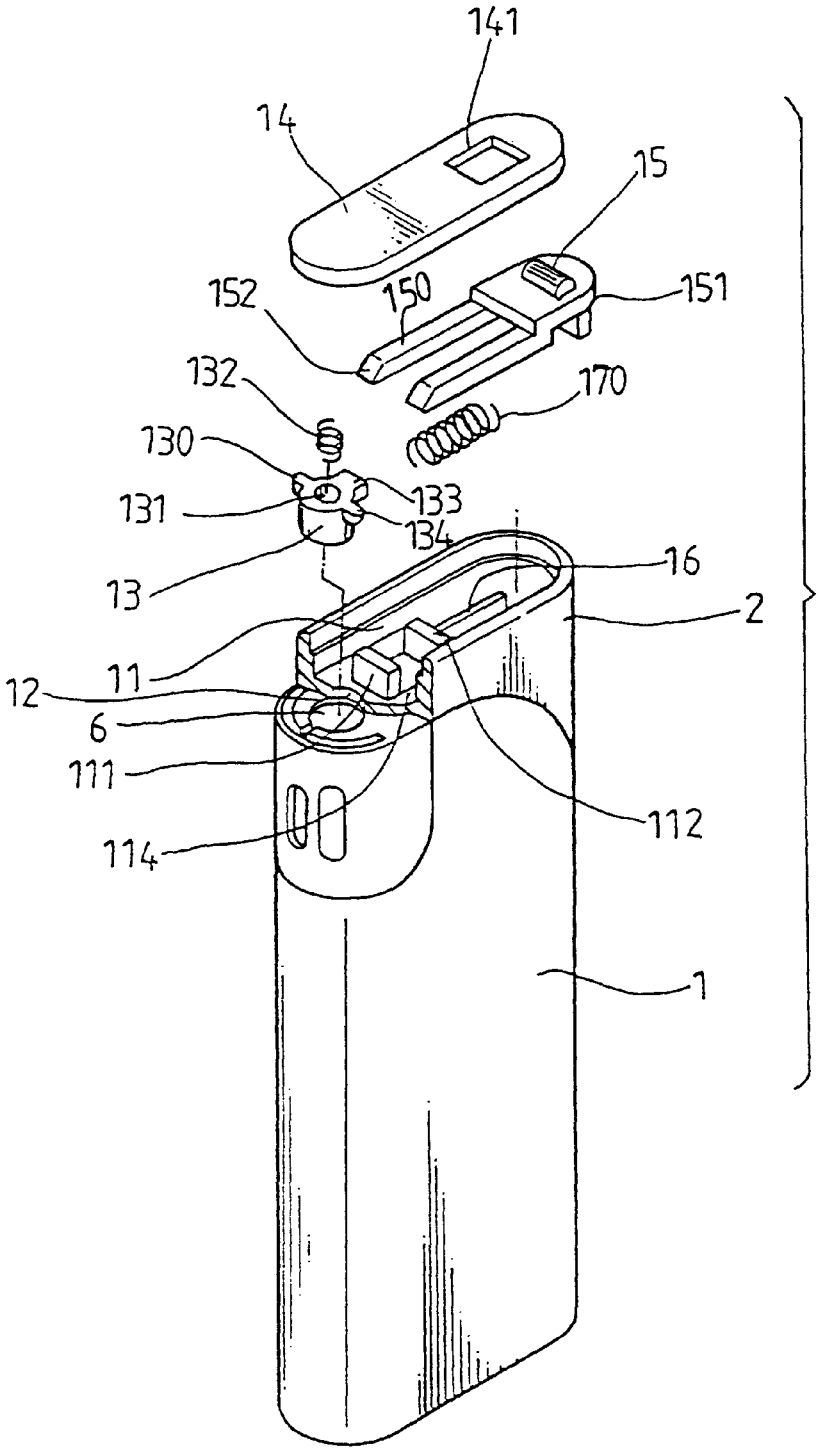
FIG. 6 is a partial exploded view illustrating the other application of the lighter.
Figure 7:
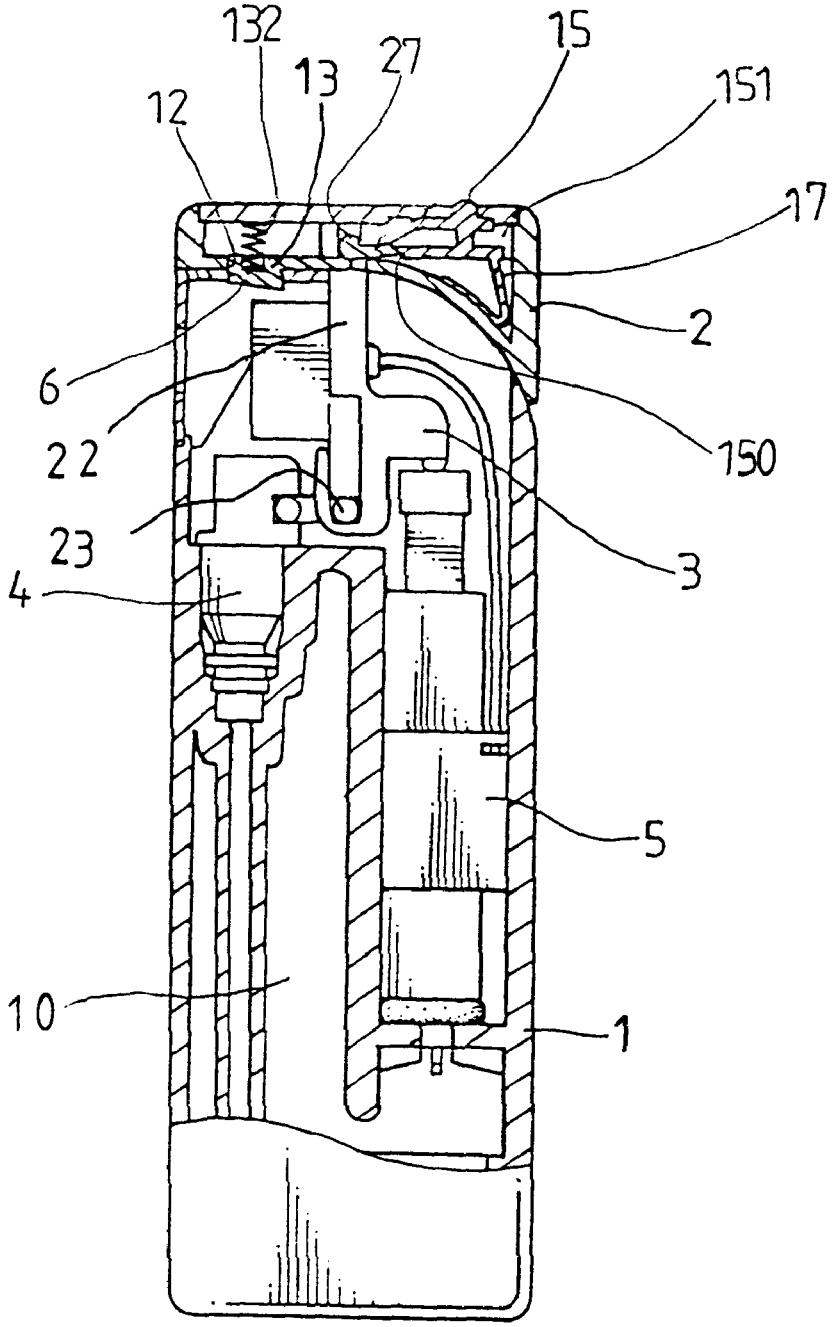
FIG. 7 is a partial cross sectional view illustrating the further application of the lighter.

Referring next to FIG. 6, instead of the spring blade 17, a spring 170 is received in the cap 2 and engaged with the knob 15 for biasing the legs 150 of the knob 15 from the latch 13. Referring next to FIG. 7, the latch 13 may include an extension 27 extended toward the knob 15 which includes one or more shorter legs 150 to actuate the extension 27 of the latch 13 and to disengage the latch 13 from the orifice 6 of the housing 1.

Accordingly, the lighter in accordance with the present invention includes a safety mechanism for preventing the cap from being actuated inadvertently by the children.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lighter comprising:

a) a housing including a chamber formed therein for receiving gas fuel therein, and including an ignitor device received therein, said housing including an orifice formed therein for allowing the gas fuel to flow outward of said housing, b) a cap pivotally secured to said housing at a pivot shaft, said cap including an aperture for aligning with said orifice of said housing, c) a latch slidably engaged in said aperture of said cap and said orifice of said housing, and d) means for disengaging said latch from said orifice of said housing, said cap being allowed to be rotated about said pivot shaft when said latch is disengaged from said orifice of said housing.

2. The lighter according to claim 1 further comprising means for biasing said latch to engage into said orifice of said housing.

3. The lighter according to claim 1, wherein said latch includes at least one arm laterally extended outward therefrom, said disengaging means includes a knob slidably received in said cap and having at least one leg extended therefrom for engaging with said at least one arm and for disengaging said latch from said orifice of said housing.

4. The lighter according to claim 3, wherein said at least one leg includes a tapered end, said at least one arm includes a tapered end for engaging with tapered end of said at least one leg.

5. The lighter according to claim 3 further comprising means for biasing said knob away from said latch.

6. The lighter according to claim 5, wherein said biasing means includes a spring blade extended from said knob and engaged with said cap for biasing said knob away from said latch.

7. The lighter according to claim 6, wherein said cap includes a cavity formed therein, said spring blade includes a bulge extended therefrom for engaging with said cavity of said cap and for positioning said spring blade to said cap.

8. The lighter according to claim 3, wherein said cap includes a lid having an opening formed therein for slidably receiving said knob, and for allowing said knob to be moved toward said latch.

9. The lighter according to claim 1 further comprising means for guiding said latch to move relative to said cap.

10. The lighter according to claim 9, wherein said guiding means includes a block extended in said cap, said latch has a projection slidably engaged with said block of said cap.

* * * * *